United States Patent [19]

Phillips et al.

[11] 4,073,293

[45] Feb. 14, 1978

[54] NOZZLE TIP

[75] Inventors: Ian Ross Phillips, Pymble; Mervyn Frank Reynolds, Dee Why, both of Australia

[73] Assignee: N. J. Phillips Pty. Limited, Dee Why, Australia

[21] Appl. No.: 725,051

[22] Filed: Sept. 21, 1976

[30] Foreign Application Priority Data

Nov. 27, 1975 Australia ..... 4086/75

[51] Int. Cl.[2] ..... A61D 7/00

[52] U.S. Cl. ..... 128/223; 128/239

[58] Field of Search ..... 128/223, 224, 239, 240, 128/241, 242; 239/86

[56] References Cited

U.S. PATENT DOCUMENTS

| | | | |
|---|---|---|---|
| 695,470 | 3/1902 | Milam | 128/241 |
| 877,926 | 2/1908 | Hilker | 128/241 |
| 2,043,882 | 6/1936 | Cheek | 128/241 |

FOREIGN PATENT DOCUMENTS

| | | | |
|---|---|---|---|
| 807,210 | 1/1937 | France | 128/241 |
| 658,227 | 1/1929 | France | 128/240 |

*Primary Examiner*—John D. Yasko

*Attorney, Agent, or Firm*—Ladas, Parry, Von Gehr, Goldsmith & Deschamps

[57] ABSTRACT

A flow control apparatus positionable within the discharge nozzle of a drench gun to control leakage of liquid therethrough by means of a series of holes to increase the surface tension within the liquid adjacent the liquid outlet of the nozzle.

4 Claims, 4 Drawing Figures

NOZZLE TIP

The present invention relates to nozzles for liquid dispensers and more particularly but not exclusively to nozzles for drench guns.

The known apparatus used for delivering drenches to animals is a nozzle consisting of a nozzle tube with a tip fixed to one end through which the drench is ejected. The other end of the nozzle tube is attached to an instrument for delivering and measuring the desired dosage of drench. An example of such an instrument is described in Australian Patent Application No. 13102/76 (corresponding applications, U.S. Ser. No. 678,578; United Kingdom 18308/76; New Zealand 180618 and South Africa 76/2398).

It is a disadvantage of known apparatus that difficulty is sometimes experienced in controlling a run through of liquid (drench) after delivery of the required dose, particularly in larger dose instruments.

It is the object of the present invention to ameliorate the above disadvantage.

In a first general form the present invention is a flow control apparatus locatable within a discharge nozzle to control the leakage of liquid therethrough by increasing the surface tension of the liquid, said apparatus having a liquid inlet and a liquid outlet through which liquid ejected from the nozzle must pass, duct means providing liquid communication between said liquid outlet and inlet, said duct means including a main passage terminating within said apparatus and a series of smaller passages in communication therewith to provide a region of higher surface tension when a free surface of said liquid is located adjacent said smaller passages.

In a second general form the present invention is a nozzle tip insert to control leakage of drench via the nozzle by providing a region of high surface tension in the drench; said tip comprising a body dimensioned to be sealingly fitted within the nozzle tip so that drench ejected from the gun must pass through the insert, said body having a liquid inlet to be located within the nozzle and a liquid outlet to be located adjacent the free end of the nozzle, duct means providing liquid communication between said liquid inlet and said liquid outlet, said duct means including a main passage extending from said liquid outlet and terminating within said body, said liquid inlet including a series of smaller passages providing communication between the upstream portion of said nozzle with said main passage to thereby form a region of higher surface tension in a free surface of said drench adjacent said smaller passages.

In a third general form the present invention is a drench gun having at least one interacting bore and piston defining a variable volume working space, a liquid inlet to said space to be connected to a supply of drench, a one-way valve located in said inlet permitting drench to enter said space, a liquid outlet from said space to deliver drench forced there from a one-way valve located in said liquid outlet permitting drench to leave said space, a nozzle extending from said liquid outlet, a nozzle tip located at the free end of said nozzle, said nozzle tip having a central longitudinally extending cylindrical passage communicating with the liquid passage within said nozzle, a nozzle tip insert of generally cylindrical shape located in said passage to provide a region of high surface tension in said drench to control leakage of drench through said nozzle, a stepped portion adjacent the drench exit of said nozzle tip, a flange at one end of said nozzle tip insert engageable with said stepped portion to securely locate said nozzle tip insert within said cylindrical passage, said passage being of larger diameter than said nozzle tip insert except at said stepped portion, said nozzle tip insert having a main passage extending inwardly from the flanged end but terminating short of the other end, a series of smaller passages extending inwardly from the peripheral surface of said tip to said main passage thereby providing communication between the nozzle tip passage and said main passage to form a region of higher surface tension when a free surface of said drench is located adjacent said smaller passages.

A preferred form of the invention will now be described by way of example with reference to the accompanying drawings, wherein.

Figure 1:
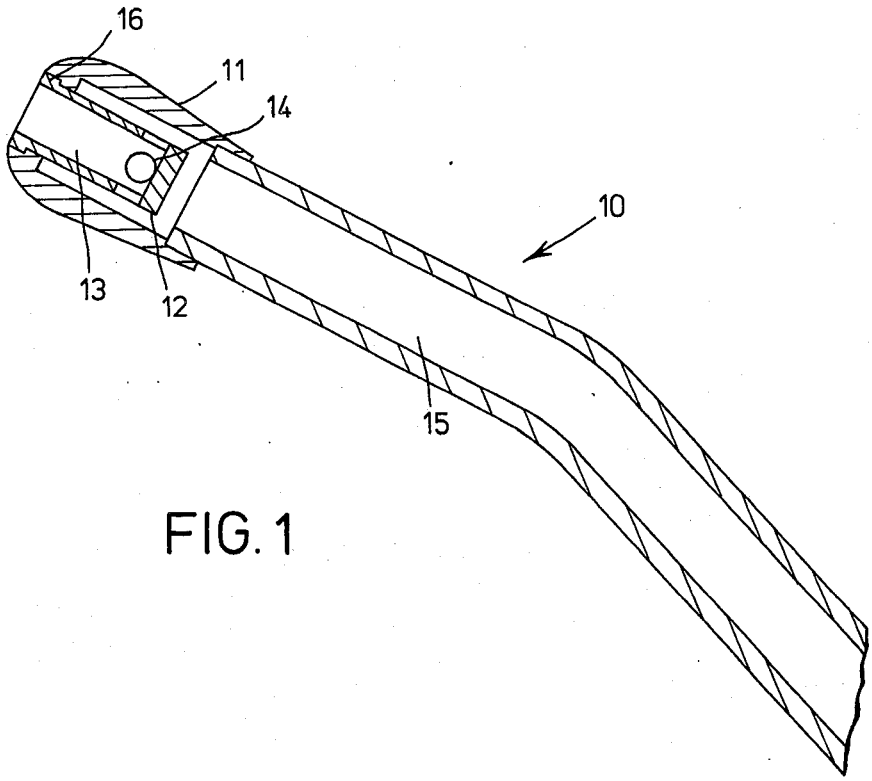
FIG. 1 is a sectioned elevation depicting a nozzle according to an embodiment of the invention.
Figure 2:
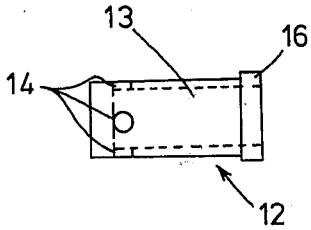
FIG. 2 is a side elevation depicting the nozzle tip insert of FIG. 1.
Figure 3:
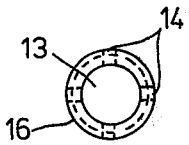
FIG. 3 is a front elevation of the nozzle tip insert of FIGS. 1 and 2.

The nozzle 10 is depicted having a nozzle tip 11 with insert 12 located therein. The insert has a central passage 13 terminating with smaller inlet passages 14 which communicate with the main passage 15 of the nozzle 10. The insert 12 is held in position by end stepped portion 17 and the engagement therewith by the flange 16.

The inlet passages 14, through which liquid must pass when forced from passage 15 to passage 13, act to retain the liquid within the gun by employing the surface tension of the liquid. That is the total force acting on the area of each passage 14, when the liquid is not under pressure from the piston of the gun, does not exceed the retaining force of the surface tension acting across each passage 14. In this manner the smaller inlet passages 14 provide a region of high surface tension to control the leakage of liquid through the nozzle.

Figure 1A:
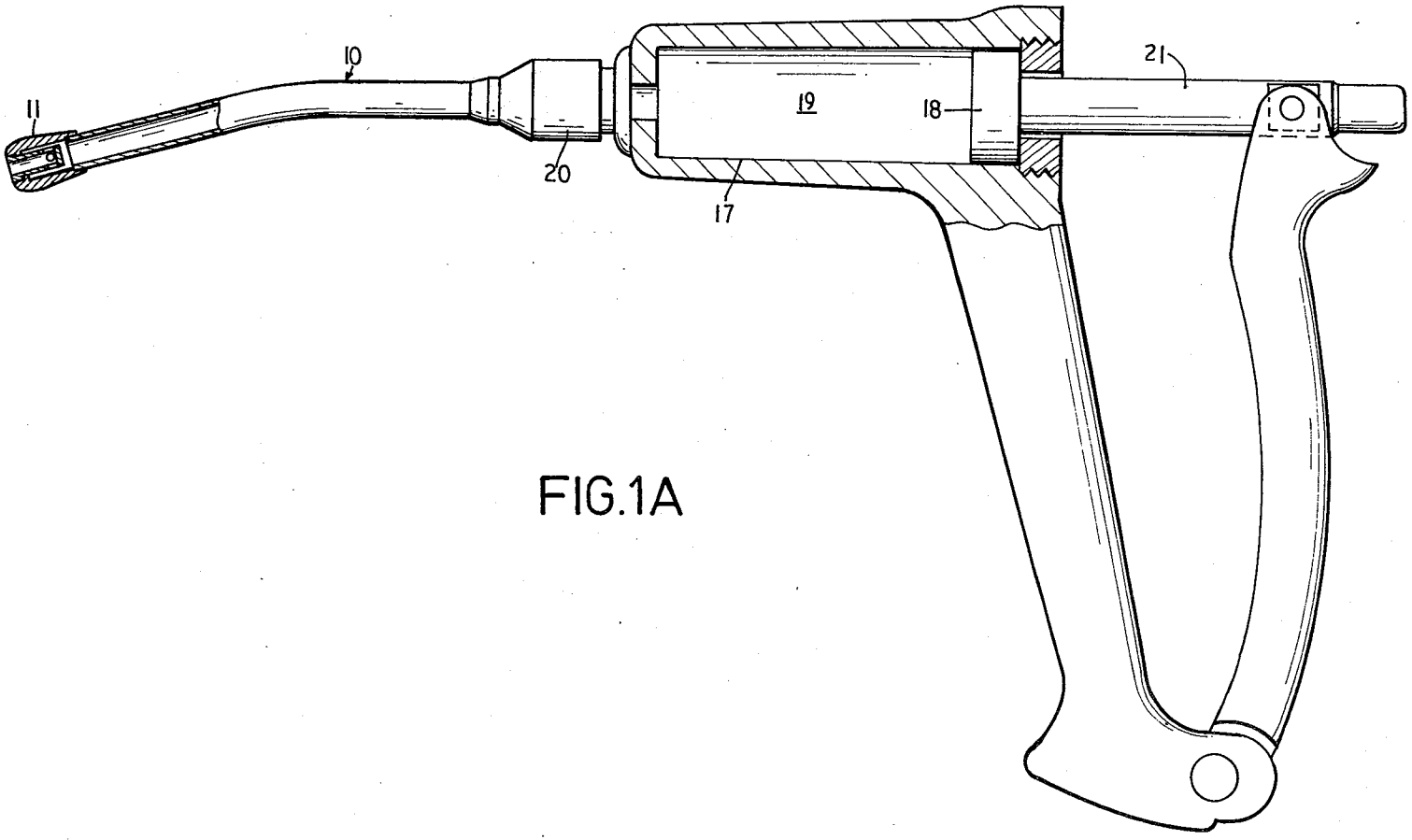
FIG. 1A is a part sectioned elevation of a drench gun having the nozzle of FIG. 1 attached thereto.

The nozzle 10 is of the kind used in drench guns, which guns are employed to deliver a dosage of drench to animals by injecting the drench into the throat of the animal. The gun of FIG. 1A is an example of such guns and is depicted having an interacting bore and piston 17 and 18 which define a variable volume working space 19. When the volume is increased, drench is drawn into the space through a one-way valve located in the hollow piston rod 21. When the volume decreases, drench in the space is forced out through a second one-way valve 20 and through the nozzle 10. The inlet valve in rod 21 is located in an inlet passage extending through the rod 21 and to which a reservoir containing drench is connected in a conventional manner.

What we claim is:

1. A drench gun nozzle tip insert to control leakage of drench via the nozzle by providing a region of high surface tension in the drench; said tip comprising a body dimensioned to be sealingly fitted within the nozzle tip so that drench ejected from the gun must pass through the insert, said body having a liquid inlet to be located within the nozzle and a liquid outlet to be located adjacent the free end of the nozzle, duct means providing liquid communication between said liquid inlet and said liquid outlet, said duct means including a main passage extending from said liquid outlet and terminating within said body, said liquid inlet including a series of smaller passages providing communication between the upstream portion of said nozzle with said main passage to thereby form a region of high surface tension in a free surface of said drench adjacent said smaller passages, said body being generally of tubular shape with a flange at one end and with said smaller passages extending radially inwardly from the peripheral surface of the body adjacent the other end to said one end, and said main passage extending longitudinally from the end face of the body adjacent the flange but terminating short of the other end face.

2. A drench gun nozzle tip insert according to claim 1 wherein there are four smaller passages.

3. A drench gun having at least an interacting bore and piston defining a variable volume working space, a liquid inlet to said space to be connected to a supply of drench, a one-way valve located in said inlet permitting drench to enter said space, a liquid outlet from said space to deliver drench forced from said space, a one-way valve located in said liquid outlet permitting drench to leave said space, a nozzle extending from said liquid outlet, a nozzle tip located at the free end of said nozzle, said nozzle tip having a central longitudinally extending cylindrical passage communicating with the liquid passage within said nozzle, a nozzle tip insert of generally cylindrical shape located in said passage to provide a region of high surface tension in said drench to control leakage of drench through said nozzle, a stepped portion adjacent the drench exit of said nozzle tip, a flange at one end of said nozzle tip insert engageable with said stepped portion to securely locate said nozzle tip insert within said passage, said passage being of larger diameter than said nozzle tip insert except at said stepped portion, said nozzle tip insert having a main passage extending inwardly from the flanged end but terminating short of the other end, a series of smaller passages extending inwardly from the peripheral surface of said tip to said main passage thereby providing communication between the nozzle tip passage and said main passage to form a region of higher surface tension when a free surface of said drench is located adjacent said smaller passages.

4. A drench gun nozzle tip insert to control leakage of drench via the nozzle by providing a region of high surface tension in the drench; said tip insert comprising a body dimensioned to be sealingly fitted within the nozzle tip so that drench ejected from the gun must pass through the insert, said body having a liquid inlet at one end to be located within the nozzle and a liquid outlet at the other end to be located adjacent the free end of the nozzle, duct means providing liquid communication between said liquid inlet and said liquid outlet, said duct means including a main passage extending from said liquid outlet and terminating within said body, said liquid inlet including a series of smaller passages providing communication between the upstream portion of said nozzle with said main passage to thereby form a region of high surface tension in a free surface of said drench adjacent said smaller passages, said body being of generally tubular shape with said smaller passages extending radially inwardly from the peripheral surface of the body adjacent said one end, and said main passage extending longitudinally from the face of the body at said other end but terminating short of the face at said one end.

* * * * *